US012063965B2

(12) United States Patent
Ouyang

(10) Patent No.: US 12,063,965 B2
(45) Date of Patent: Aug. 20, 2024

(54) ELECTRONIC CIGARETTE WITH DETACHABLE HEATING CHAMBER

(71) Applicant: SHENZHEN IVPS TECHNOLOGY CO., LTD., Guangdong (CN)

(72) Inventor: Junwei Ouyang, Shenzhen (CN)

(73) Assignee: Shenzhen IVPS Technology Co. Ltd., Shenzhen (CN)

( * ) Notice: Subject to any disclaimer, the term of this patent is extended or adjusted under 35 U.S.C. 154(b) by 1360 days.

(21) Appl. No.: 16/503,525

(22) Filed: Jul. 4, 2019

(65) Prior Publication Data

US 2020/0008476 A1 Jan. 9, 2020

(30) Foreign Application Priority Data

Jul. 5, 2018 (CN) ..... 201821063451.X

(51) Int. Cl.
*A24F 40/46* (2020.01)
*A24F 40/20* (2020.01)

(52) U.S. Cl.
CPC ..... *A24F 40/46* (2020.01); *A24F 40/20* (2020.01)

(58) Field of Classification Search
CPC ..... A24F 40/20; A24F 40/46
USPC ..... 131/329
See application file for complete search history.

(56) References Cited

U.S. PATENT DOCUMENTS

2014/0202476 A1* 7/2014 Egoyants et al. ..... A24F 7/00 131/329
2020/0367562 A1* 11/2020 Liu et al. ..... A24F 40/46

FOREIGN PATENT DOCUMENTS

CH WO 2013/076098 A2 * 5/2013 ..... A24F 47/00
CN 106617324 A * 5/2010 ..... A24F 47/008
WO 2016124550 A1 8/2016

OTHER PUBLICATIONS

CN106617324A_Espacenet Mach English (Year: 2023).*

* cited by examiner

*Primary Examiner* — Christopher M Rodd
*Assistant Examiner* — Ronnie Kirby Jordan
(74) *Attorney, Agent, or Firm* — IP-PAL Patent US

(57) ABSTRACT

The present invention discloses an electronic cigarette, which comprises a main body, a controlling member and a tobacco pot detachably mounted on the main body, wherein the main body is provided with a receiving chamber with an opening; the tobacco pot is provided with a receiving space configured to receive tobacco products, the tobacco pot is received at the first position in the receiving chamber when the tobacco pot is mounted on the main body; the controlling member is movably mounted on the main body and is configured to drive the tobacco pot to move, and when the controlling member drives the tobacco pot to move from the first position to the second position of the receiving chamber, the tobacco pot partially protrudes from the opening of the receiving chamber outside the receiving chamber.

16 Claims, 5 Drawing Sheets

ELECTRONIC CIGARETTE WITH DETACHABLE HEATING CHAMBER

TECHNICAL FIELD

The present invention relates to an electronic cigarette.

BACKGROUND

Studies have shown the use of "heating non-burning". Related studies have shown that nicotine and some tobacco flavor components can be transferred to smoke in a manner of only heating but not burning tobacco at a lower temperature below 500° C. Compared to traditional burning cigarettes, low temperature cigarettes can significantly reduce the release of tar and harmful components as a whole. At the same time, there is basically no sidestream smoke, which is of little harm to others and the environment.

However, the existing low-temperature flue-cured tobacco is usually provided with a heating chamber inside the electronic cigarette to heat the tobacco products, and the heating chamber cannot be removed from the electronic cigarette, which is inconvenient for the user to clean.

SUMMARY

The main object of the present invention is to provide an electronic cigarette, which is intended to facilitate the user to clean the heating chamber.

In order to achieve the above object, the present invention provides an electronic cigarette, comprising: a main body, a controlling member, and a tobacco pot detachably mounted on the main body, wherein the main body 10 is provided with a receiving chamber with an opening;

the tobacco pot is provided with a receiving space configured to receive tobacco products, the tobacco pot is received at the first position in the receiving chamber when the tobacco pot is mounted on the main body;

the controlling member is movably mounted on the main body and is configured to drive the tobacco pot to move, and when the controlling member drives the tobacco pot to move from the first position to the second position of the receiving chamber, the tobacco pot partially protrudes from the opening of the receiving chamber outside the receiving chamber.

Preferably, the tobacco pot comprises a large-diameter section and a small-diameter section, a connecting portion is formed at the intersection of the large-diameter section and the small-diameter section, the controlling member is abutted against the connecting portion when moving to be in contact with the tobacco pot, so that the controlling member drives the tobacco pot to move when moving along the main body, and when the tobacco pot moves to the second position, the large-diameter section protrudes from the opening of the receiving chamber.

Preferably, the controlling member comprises a controlling portion and a driving portion connected to the controlling portion, the controlling portion is movably mounted on the main body and exposed to an outer surface of the main body, when the controlling portion moves to the driving portion to be in contact with the connecting portion, the driving portion is connected to the connecting portion so that the controlling portion drives the tobacco pot to move when moving along the main body.

Preferably, the driving portion is provided with a retaining hole, when the tobacco pot is mounted on the main body, the small-diameter section partially passes through the retaining hole, and the driving part abuts when moving to be in contact with the large-diameter section, so that the controlling portion is connected to the connecting portion.

Preferably, the tobacco pot is further provided with at least one air inlet, and the receiving space is in communication with external environment through the air inlet.

Preferably, the tobacco pot is further provided with at least one hollow cleaning tank for exposing the receiving space from the tobacco pot.

Preferably, the main body is provided with a heat generating device, and the heat generating device heats the receiving chamber when the main body operates so that the receiving chamber partially forms a heating section.

Preferably, the tobacco pot is provided with a portion corresponding to the heat generating device, when the tobacco pot is mounted on the receiving chamber, the heat generating device is partially inserted into the portion, and when the tobacco pot moves from the first position to the second position, the portion of the tobacco pot is partially detached from the heat generating device.

Preferably, the heat generating device comprises a heat generating rod, the portion is an through hole through which the outside is communicated with the receiving space, one end of the heat generating rod is mounted on the main body and is electrically connected to an internal electric component of the main body, and the other end of the heat generating rod passes through the through hole and is received in the receiving space.

Preferably, the electronic cigarette further comprises a heat insulating sleeve, the heat insulating sleeve is mounted in the receiving chamber and at least covers the inner chamber wall of the heating section of the receiving chamber, and the heat insulating sleeve is hollow, so that the tobacco pot partially passes the insulating sleeve.

The electronic cigarette of the technical solution of the present invention is provided with a receiving chamber with an opening in the main body, and then the tobacco pot is movably mounted on the main body; when the tobacco pot is mounted on the main body, the tobacco pot is received in the first position of the receiving chamber such that the tobacco products received in the receiving space of the tobacco pot can be heated by the heating element inside the main body to generate smoke for the user to suction when the main body operates; then a controlling member, which is configured to drive the tobacco pot to move, is movably mounted on the main body, when the controlling member drives the tobacco pot to move from the first position to the second position of the receiving chamber, the tobacco pot partially protrudes from the opening of the receiving chamber to the outside for the user to hold, and then the tobacco pot is pulled out of the receiving chamber, so that the tobacco pot is detached from the main body; the problem that the tobacco pot is fixedly mounted in the main body in the traditional electronic cigarette, which results in inconvenience to clean, is effectively solved. At the same time, the tobacco pot is cleaned after being detached, effectively preventing the phenomenon that water remains in the main body during the cleaning process or is immersed in the main body to cause damage to the electronic components inside the main body, which makes it more convenient to clean.

BRIEF DESCRIPTION OF THE DRAWINGS

For a better illustration of the embodiments of the present invention or the technical solution in the prior art, accompanying drawings needed in the description of the embodiments or the prior art are simply illustrated below. Obviously, the accompanying drawings described below are some embodiments of the present invention. For those skilled in the art, other accompanying drawings may be obtained according to the structure shown in these accompanying drawings without creative work.

Figure 1:
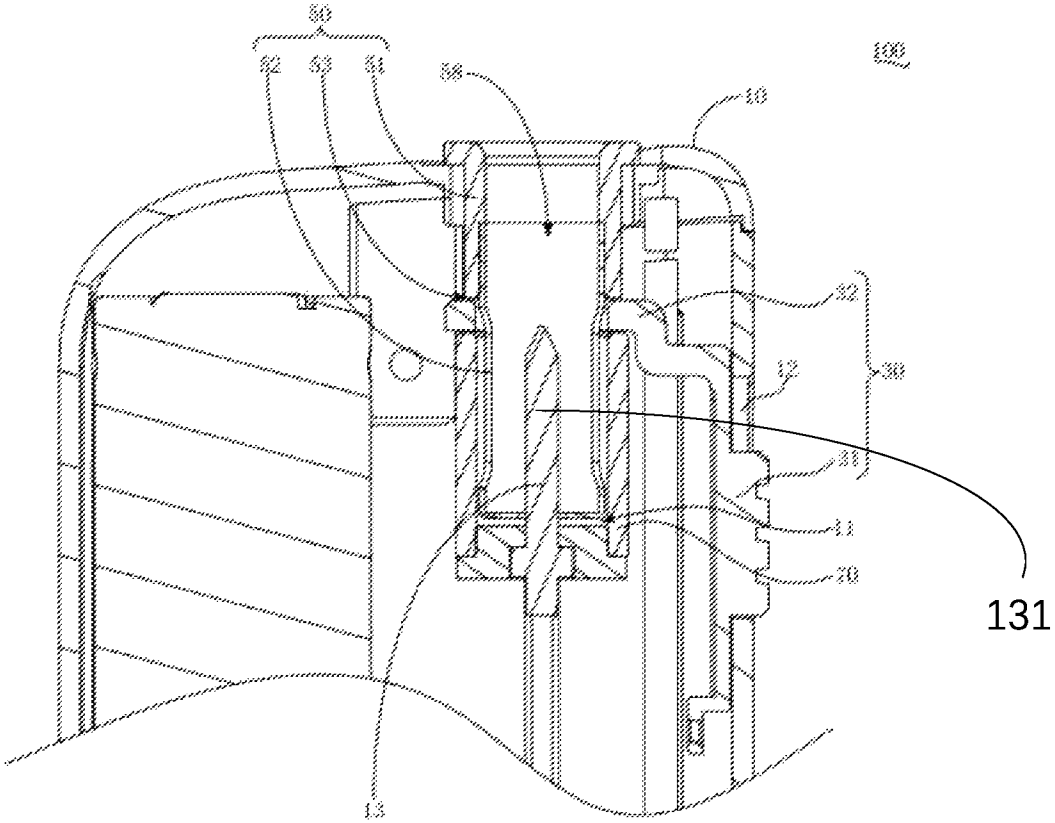
FIG. 1 is a cross-sectional schematic diagram illustrating a connecting structure of a tobacco pot in an electronic cigarette in the first position according to the present invention.

Description of the reference numbers:

| Reference number | Name of part | Reference number | Name of part |
|---|---|---|---|
| 100 | electronic cigarette | 50 | tobacco pot |
| 10 | Main body | 51 | large-diameter section 51 |
| 11 | Receiving chamber | 52 | small-diameter section 52 |
| 111 | Opening | 53 | Connecting portion |
| 112 | Heating section | 54 | Portion |
| 12 | Sliding slot | 55 | Through hole |
| 13 | Heat generating device | 56 | Air inlet |
| 30 | Controlling member | 57 | Cleaning tank |
| 31 | Controlling portion | 58 | Receiving space |
| 32 | Driving portion | 70 | heat insulating sleeve |
| 321 | Retaining hole | | |

The implementation of aims, the function features and the advantages of the present disclosure are described below in further detail in conjunction with embodiments with reference to the drawings.

DESCRIPTION OF THE EMBODIMENTS

A clear and complete description as below is provided for the technical solution in the embodiments of the present invention in conjunction with the drawings in the embodiments of the present invention. Obviously, the embodiments described Hereafter are simply part embodiments of the present invention, rather than all the embodiments. All other embodiments obtained by those skilled in the art based on the embodiments in the present invention without creative work are intended to be included in the scope of protection of the present invention.

It should be noted that all directional indications (such as top, bottom, left, right, front, behind . . . ) in the embodiments of the present invention are merely to illustrate a relative position relation, a relative motion condition, etc. between each part in a certain state (for example, the state shown in the drawings). If the state changes, the directional indication changes accordingly.

In addition, if terms "first", "second", etc. appear in the present invention, they are merely for the purpose of description, but cannot be understood as the indication or implication of relative importance or as the implicit indication of the number of the designated technical features; therefore, features defined by "first" and "second" may specifically or implicitly comprise at least one such feature. In addition, technical solutions of each embodiment of the present invention may be combined mutually; however, this must be carried out on the basis that those skilled in the art can implement the combination. When the combination of technical solutions has a conflict or cannot be implemented, it should considered that such combination of technical solutions does not exist and is not in the scope of protection claimed by the present invention.

In the present invention, unless otherwise specifically stated and defined, terms "connected", "fixed", etc. should be interpreted expansively. For example, "fixed" may be fixed connection, detachable connection, or integration; may be mechanical connection or electrical connection; direct connection, indirect connection through an intermediate, or internal communication between two elements or interaction of two elements, unless otherwise specifically defined. Those skilled in the art can understand the specific implication of the above terms in the present invention according to specific conditions.

Referring to FIG. 1 to FIG. 5, the present invention provides an electronic cigarette 100. The electronic cigarette 100 comprises a main body 10, a controlling member 30, and a tobacco pot 50 detachably mounted on the main body 10, wherein the main body 10 is provided with a receiving chamber 11 with an opening 111; the tobacco pot 50 is provided with a receiving space 58 configured to receive tobacco products, the tobacco pot 50 is received at the first position in the receiving chamber 11 when the tobacco pot is mounted on the main body 10 so that the tobacco products received in the receiving space 58 are heated by the heating section 112 when the main body 10 operates; the controlling member 30 is movably mounted on the main body 10 and is configured to drive the tobacco pot 50 to move, and when the controlling member 30 drives the tobacco pot 50 to move from the first position to the second position of the receiving chamber 1, the tobacco pot 50 partially protrudes from the opening 111 of the receiving chamber 11 outside the receiving chamber 11.

The electronic cigarette 100 of the technical solution of the present invention is provided with a receiving chamber 11 with an opening 111 in the main body 10, the receiving chamber 11 comprises the heating section 112, and then the tobacco pot 50 is movably mounted on the main body 10; when the tobacco pot 50 is mounted on the main body 10, the tobacco pot 50 is received in the first position of the receiving chamber 11 such that the tobacco products received in the receiving space 58 of the tobacco pot 50 can be heated by the heating section 112 to generate smoke for the user to suction when the main body 10 operates; then a controlling member 30, which is configured to drive the tobacco pot 50 to move, is movably mounted on the main body 10, when the controlling member 30 drives the tobacco pot 50 to move from the first position to the second position of the receiving chamber 11, the tobacco pot 50 partially protrudes from the opening 111 of the receiving chamber 11 to the outside for the user to hold, and then the tobacco pot 50 is pulled out of the receiving chamber 11, so that the tobacco pot 50 is detached from the main body 10; the problem that the tobacco pot 50 is fixedly mounted in the main body 10 in the traditional electronic cigarette 100, which results in inconvenience to clean, is effectively solved. At the same time, the tobacco pot 50 is cleaned after being detached, effectively preventing the phenomenon that water remains in the main body 10 during the cleaning process or is immersed in the main body 10 to cause damage to the electronic components inside the main body 10, which makes it more convenient to clean.

Specifically, as shown in FIG. 1, FIG. 2, FIG. 4 or FIG. 5, in the embodiment of the present invention, the tobacco pot 50 is provided with a connecting portion 53, the controlling member 30 comprises a controlling portion 31 and a driving portion 32 connected to the controlling portion 31, the controlling portion 31 is movably mounted on the main body 10 and exposed to an outer surface of the main body 10, when the controlling portion 31 moves to the driving portion 32 to be in contact with the connecting portion 53, the driving portion 32 is connected to the connecting portion 53 so that the controlling portion 31 drives the tobacco pot 50 to move when moving along the main body 10. Here, in the present embodiment, the main body 10 is provided with a sliding slot 12, the controlling portion 31 is slidably mounted in the sliding slot 12 and exposed to the outer surface of the main body 10 for driving by a user; one end of the driving portion 32 is mounted on the controlling portion 31, and the other end extends into the main body 10, so that when the user drives the controlling portion 31 to slide, the driving portion 32 is driven to move; when moving to be in contact with the connecting portion 53, the driving portion 32 is connected to the connecting portion 53 so that when the user drives the controlling portion 31 to slide, the pot body is driven to move. Thereby, the user drives the pot body to move from the first position to the second position by the controlling member 30, which is convenient for the user to detach the pot body from the main body 10 for cleaning.

It can be understood that, in the actual application process, it is not limited to the manner in which the main body 10 is provided with a sliding slot 12, the controlling portion 31 is slidably mounted in the sliding slot 12, and the driving portion 32 extends into the main body 10 to realize control. For example, a sliding rail may be provided on an outer wall of the main body 10, the controlling portion 31 is slidably mounted on the sliding rail, one end of the driving portion 32 is connected to the controlling portion 31, and the other end extends to the opening 111 of the receiving chamber 11 to be connected to the connecting portion 53 provided in the pot body; for another example, a connecting hole in communication with the receiving chamber 11 is provided in the main body 10, when the controlling member 30 is mounted on the main body 10, one end of the controlling member passes through the connecting hole to be abutted against the connecting portion 53 provided in the pot body, and the pot body moves to move the pot body from the first position to the second position by pushing the controlling member 30. The above manners are all within the scope of protection of the present invention.

Figure 2:
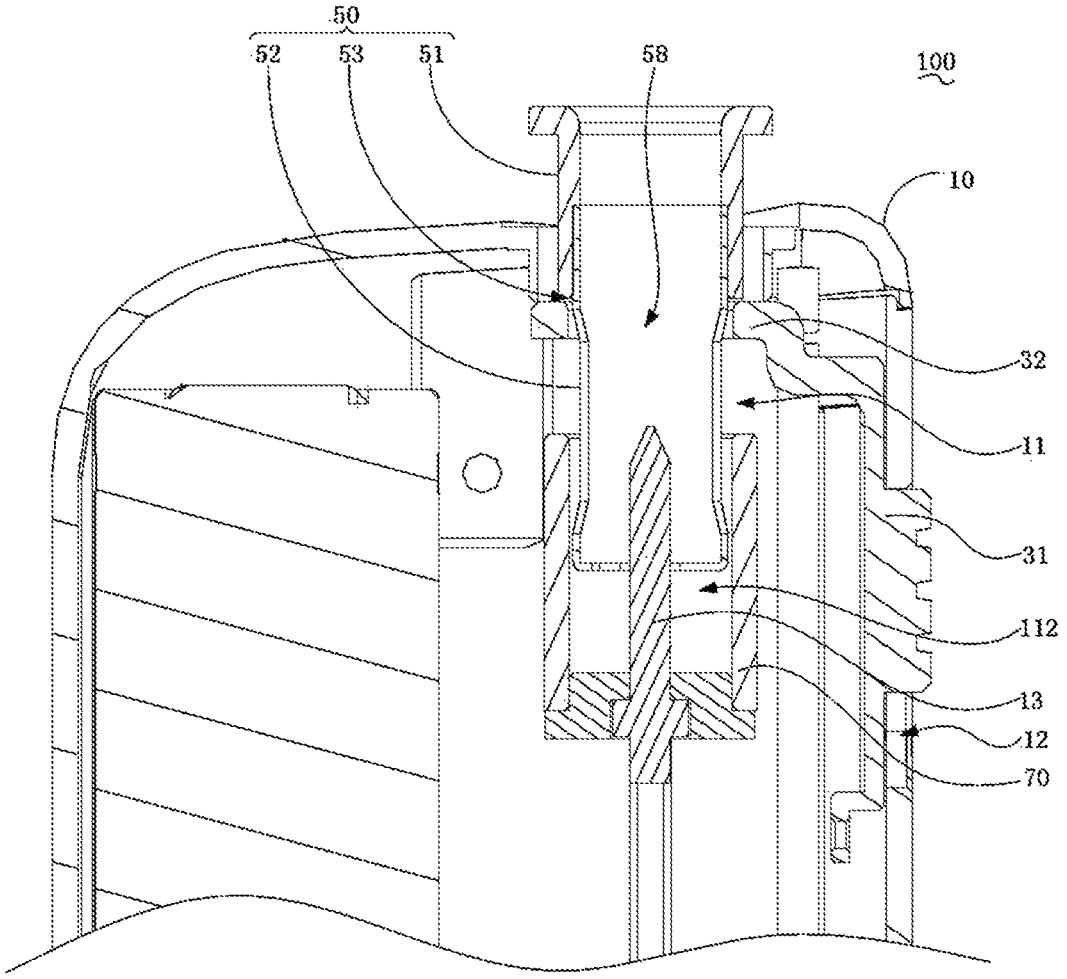
FIG. 2 is a cross-sectional schematic diagram illustrating a connecting structure of a tobacco pot in an electronic cigarette in the second position according to the present invention.

Specifically, as shown in FIG. 1 and FIG. 2, in the embodiment of the present invention, the tobacco pot 50 comprises a large-diameter section 51 and a small-diameter section 52, a stepped connecting portion 53 is formed at the intersection of the large-diameter section 51 and the small-diameter section 52, the controlling member 30 is abutted against the stepped connecting portion 53 when moving to be in contact with the tobacco pot 50, so that the controlling member 30 drives the tobacco pot 50 to move when moving along the main body 10, and when the tobacco pot 50 moves to the second position, the large-diameter section 51 protrudes from the opening 111 of the receiving chamber 11. Here, in the present embodiment, the tobacco pot 50 has a cylindrical shape as a whole, and comprises a pot head of the large-diameter section 51 and a pot body of the small-diameter section 52, one end of the pot head is provided with a flange to be adapted to the side structure of the opening 111 of the receiving chamber 11 to effectively prevent external dust from entering the main body 10 from the gap between the pot head and the inner wall of the opening 111, the other end is sleeved on the outer surface of the pot body, and a stepped connecting portion 53 is formed at the intersection of the pot body and the outer wall of the pot head. The driving portion 32 abuts when sliding to be in contact with the connecting portion 53. When the driving portion 32 continues to slide, the connecting portion 53 is driven to move so that the pot head and the pot body slide together. When the pot head protrudes from the opening 111 of the receiving chamber 11 to facilitate the user to hold, the user can pull out the tobacco pot 50. At the same time, the pot head and the pot body can also be separated, which is further convenient for the user to clean. At the same time, the pot head and the pot body can be prepared using different materials, the pot head is made of the material the same as that of the outer wall of the main body 10, so that the product shape is more beautiful. The pot body received in the receiving chamber 11 can be prepared using the material with high heat resistance and high surface smoothness, which is further convenient for the user to continue to clean.

Figure 3:
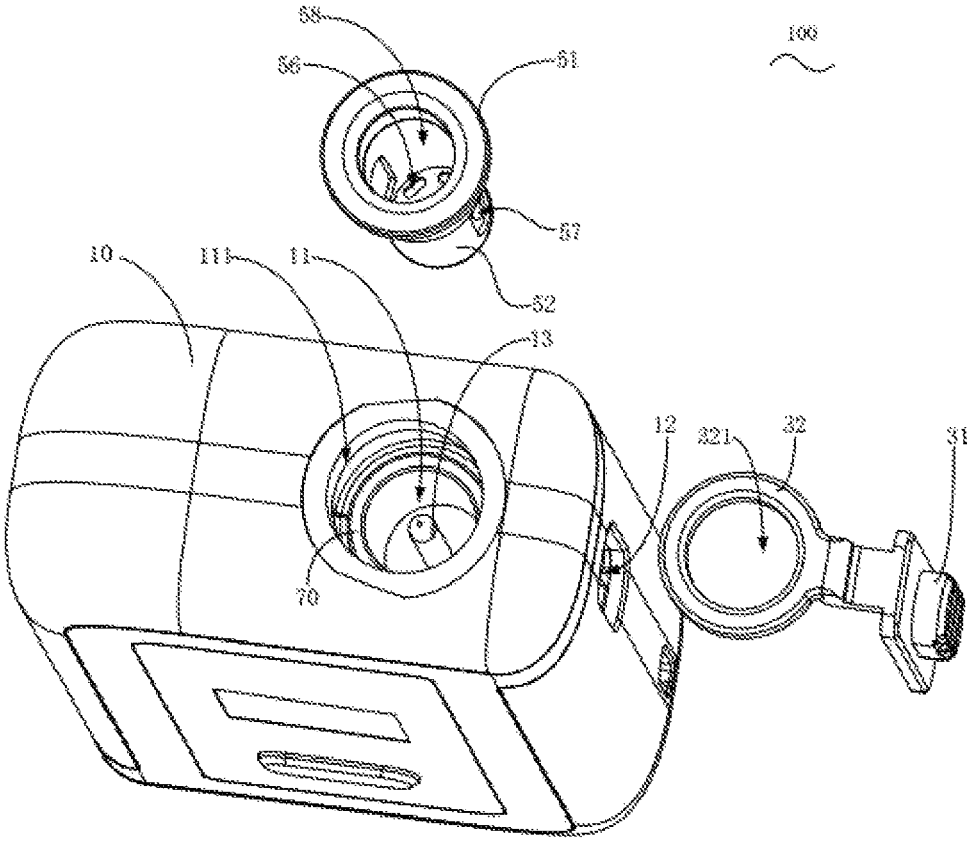
FIG. 3 is an exploded schematic diagram illustrating a connecting structure of an electronic cigarette according to the present invention.

It can be understood that, in the actual application process, the tobacco pot 50 is not limited to the above form in which the pot head and the pot body are separated, and the manner in which the pot head and the pot body are integrally formed is also within the scope of protection of the present invention. For the same reason, in the actual application process, the connecting portion 53 is not limited to the manner in which steps are formed using the large-diameter section 51 and the small-diameter section 52. For example, in another embodiment of the present invention, the manner can also be used in which the outer wall is provided with a connecting groove to form a connecting portion 53, the controlling portion 31 can drive the driving portion 32 to be inserted into the connecting groove to be abutted against the pot body, and then drive the driving portion 32 to move to the tobacco pot 50 to partially protrude from the opening 111 of the receiving chamber 11; or the manner in which a limiting block is convexly provided on the outer peripheral surface of the pot body to form a connecting portion 53 for the driving portion 32 to abut is within the scope of protection of the present invention. In addition to this, the tobacco pot 50 is not limited to the above manner in which a cylinder is used. For example, the manner in which a shape such as a prism or the like may be selected and the stepped connecting portion 53 may be formed by changing the shape, and the like, is within the scope of protection of the present invention. Specifically, as shown in FIG. 3, in the embodiment of the present invention, the driving portion 32 is provided with a retaining hole 321, when the tobacco pot 50 is mounted on the main body 10, the small-diameter section 52 partially passes through the retaining hole 321, and the driving part 32 abuts when moving to be in contact with the large diameter section 51, so that the controlling portion 31 is connected to the connecting portion 53. Here, in the present embodiment, the diameter of the retaining hole 321 is smaller than the diameter of the large-diameter section 51, so that the small-diameter section 52 is received in the heating section 112 through the retaining hole 321. When the main body 10 operates, the heating section 112 can be driven to heat the tobacco products received in the receiving space 58, and when the driving member moves to be in contact with the large-diameter section 51, the driving member is always abutted against the connecting portion 53 of the large-diameter section 51, because When the tobacco pot 50 is mounted, the tobacco pot 50 is not required to be mounted at a specific position. The connection between the driving portion 32 and the connecting portion 53 is strong in stability, effectively preventing the manner in which driving portion 32 is spliced into the splicing groove or is abutted against the limiting block. It is necessary to position the connecting portion 53 and the driving portion 32. When the tobacco pot 50 is not mounted in the positioning direction, it is easy to have the phenomenon that the controlling portion 31 cannot control the driving portion 32 to be connected with the connecting portion 53.

Specifically, as shown in FIG. 1 to FIG. 3, in the embodiment of the present invention, the main body 10 is provided with a heat generating device 13, and the heat generating device 13 heats the receiving chamber 11 when the main body 10 operates so that the receiving chamber 11 partially forms a heating section 112. Here, in the present embodiment, the heat generating end of the heat generating device 13 is received in the receiving chamber 11, and the main body 10 is further provided with a rechargeable power source for supplying power to the heat generating device 13. The heat generating device 13 is driven to generate heat so that the receiving chamber 11 partially forms the heating section 112.

It can be understood that, in the actual application process, the heat generating device 13 is not limited to the above manner of being partially received in the receiving chamber 11 to heat the receiving chamber 11. For example, the manner in which the heat generating device 13 can also be received in the main body 10 to heat the receiving chamber 11 by heating the inner wall of the receiving chamber 11 is within the scope of protection of the present invention.

Figure 4:
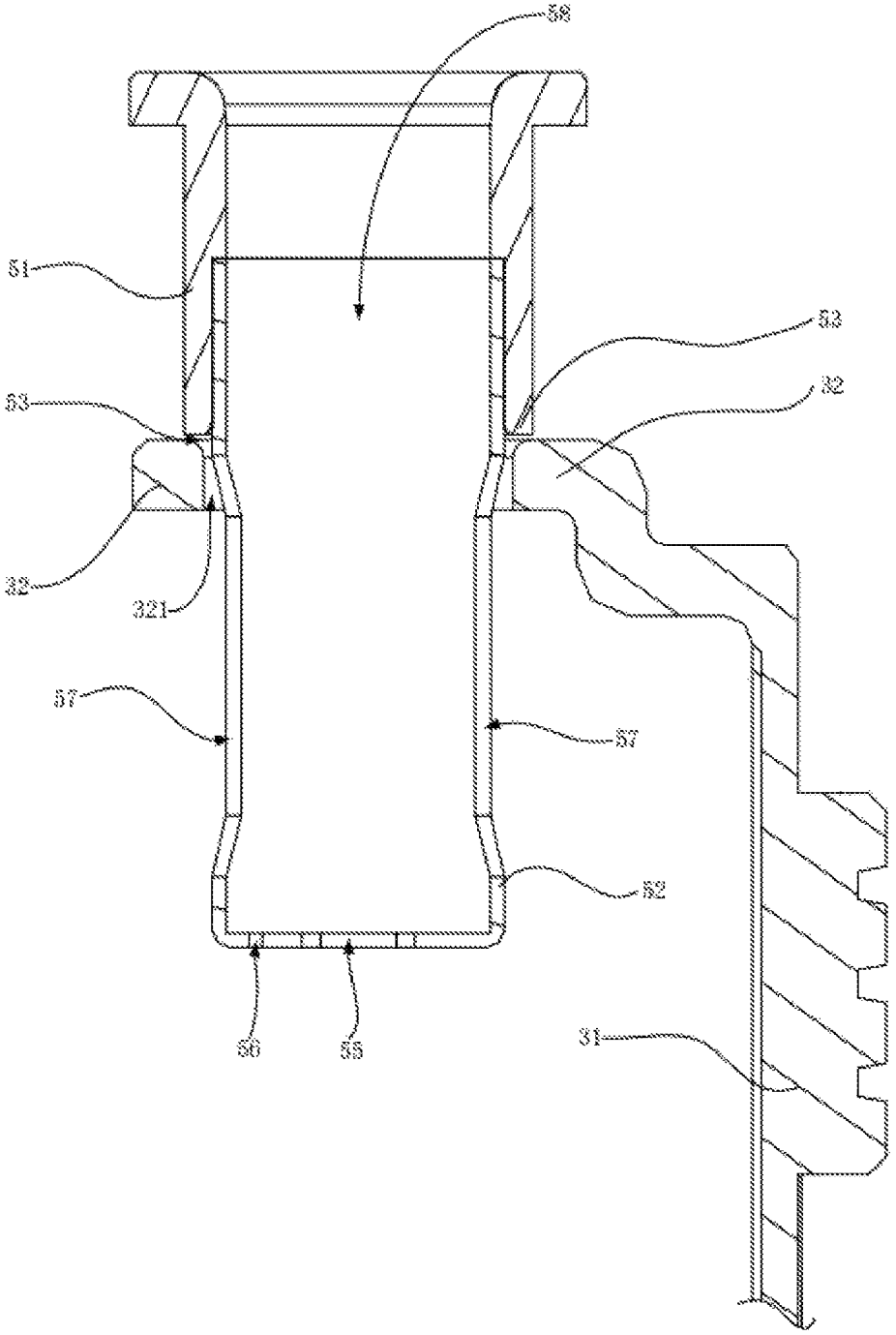
FIG. 4 is a schematic diagram illustrating a connecting structure of a controlling member and a tobacco pot in an electronic cigarette according to the present invention.
Figure 5:
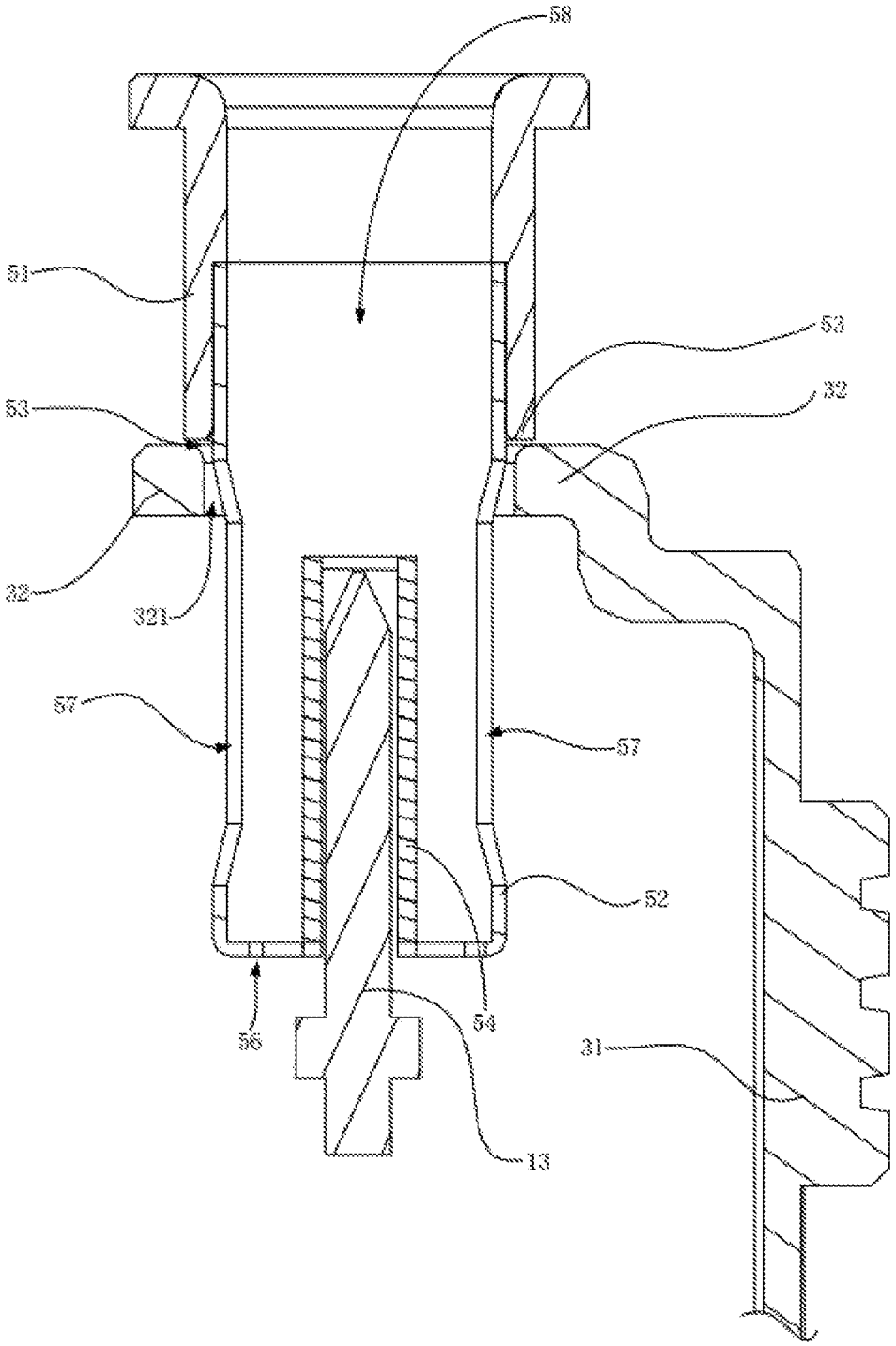
FIG. 5 is a schematic diagram illustrating a connecting structure of a controlling member and a tobacco pot in an electronic cigarette according to another embodiment of the present invention.

Specifically, as shown in FIG. 4 or FIG. 5, in the embodiment of the present invention, the tobacco pot 50 is provided with an portion 54 corresponding to the heat generating device 13, when the tobacco pot 50 is mounted on the receiving chamber 11, the heat generating device 13 is partially inserted into the portion 54, and when the tobacco pot 50 moves from the first position to the second position, the portion 54 of the tobacco pot 50 is partially detached from the heat generating device 13. Here, in the present embodiment, the heat generating device 13 is partially received in the middle of the bottom chamber wall of the receiving chamber 11. The tobacco pot 50 is provided with an portion 54 corresponding to the heat generating device 13. The area enclosed by the outer periphery of the portion 54 is larger than the area formed by the outer periphery of the heat generating device 13. Therefore, when the tobacco pot 50 is spliced into the mounting chamber, the portion 54 is always interfaced with the heat generating device 13, effectively preventing the phenomenon that when the heat generating device 13 is provided at other positions of the receiving chamber 11, the tobacco pot 50 needs to be spliced into the receiving chamber 11 in a certain direction in order to prevent the tobacco pot 50 from being abutted against the heat generating device 13, resulting in inconvenience to mount.

Specifically, as shown in FIG. 1 to FIG. 5, in the embodiment of the present invention, the heat generating device 13 comprises a heat generating rod 131, the portion 54 is an through hole 55 through which the outside is communicated with the receiving space 58, one end of the heat generating rod 131 is mounted on the main body 10 and is electrically connected to an internal electric component of the main body 10, and the other end of the heat generating rod 131 passes through the through hole 55 and is received in the receiving space 58. Here, in the present embodiment, the heat generating device 13 adopts a cylindrical heat generating rod 131. The portion 54 is in the form of the through hole 55, so that when the tobacco pot 50 does not need to be positioned and is spliced into the main body 10 along the receiving chamber 11 in any direction, the heat generating rods 131 are received in the receiving space 58 through the through holes 55, the tobacco products are directly heated and baked, and the heating efficiency is high, which is convenient for the user to mount.

It can be understood that, in the actual application process, the present invention is not limited to the above form of the through hole 55; for example, in another embodiment of the present invention, the manner, in which the sleeve 50 is provided in the tobacco pot 50, the sleeve is provided corresponding to the heat generating rod 131, and when the tobacco pot 50 is spliced into the main body 10 along the mounting chamber, the sleeve is sleeved on the outer surface of the heat generating rod 131, is also within the scope of protection of the present invention.

Specifically, as shown in FIG. 1 to FIG. 3, in the embodiment of the present invention, the electronic cigarette 100 further comprises a heat insulating sleeve 70, the heat insulating sleeve 70 is mounted in the receiving chamber 11 and at least covers the inner chamber wall of the heating section 112 of the receiving chamber 11, and the heat insulating sleeve 70 is hollow, so that the tobacco pot 50 partially passes the heat insulating sleeve 70. Here, in the present embodiment, a heat insulating sleeve 70 is provided to cover the heating section 112 receiving the heat generating device 13, thereby effectively preventing the phenomenon that the heat in the receiving chamber 11 is dissipated faster so that the baking efficiency of tobacco products is low; at the same time, the internal electronic components of the electronic cigarette 100 can be effectively insulated from the heating section 112, preventing the phenomenon that the internal electronic components is damaged when operating in a high temperature environment.

Further, as shown in FIG. 3 to FIG. 5, in the embodiment of the present invention, the tobacco pot 50 is further provided with at least one air inlet 56, and the receiving space 58 is in communication with external environment through the air inlet 56. Here, in the present embodiment, the tobacco pot 50 is further provided with a plurality of air inlets 56, and the plurality of air inlets 56 are arranged at one end of the tobacco pot 50 away from the opening 111 at intervals. When the user suctions, the air flow enters from one end away from the opening 111, and flows out from the opening 111 after being mixed with the smoke generated by baking the tobacco products, and the mixing is sufficient, effectively enhancing the mouthfeel when the user suctions, and preventing the air inlet from being provided too close to the opening 111, resulting in the phenomenon that one end of the tobacco pot 50 away from the opening 111 has a high temperature, and the tobacco is easily dried in the inner wall of the tobacco pot 50, which is inconvenient to clean.

Specifically, as shown in FIG. 3 to FIG. 5, in the embodiment of the present invention, the tobacco pot 50 is further provided with at least one cleaning tank 57, and the receiving space 58 is in communication with external environment through the cleaning tank 57. Here, in the present embodiment, the outer periphery of the tobacco pot 50 is further provided with two cleaning tanks 57, and the user can extend a cleaning brush or a cotton swab into the receiving space 58 from the cleaning tank 57 provided on the outer periphery of the tobacco pot 50 for cleaning. Correspondingly, the cleaning is performed only through the mouth of the tobacco pot 50. The angle of cleaning through the cleaning tank 57 is large, and it is more convenient for the user to operate and clean from multiple directions.

The above are preferred embodiments of the present invention merely and are not intended to limit the patent scope of the present invention. Any equivalent structures made according to the description and the accompanying drawings of the present invention without departing from the idea of the present invention, or any equivalent structures applied in other relevant technical fields directly or indirectly are intended to be included in the patent scope of protection of the present invention.

What is claimed is:

1. An electronic cigarette comprising:

a main body, a controlling member, and a tobacco pot detachably mounted on the main body, wherein the main body is provided with a receiving chamber with an opening; the tobacco pot is provided with a receiving space configured to receive tobacco products, the tobacco pot is received at a first position in the receiving chamber when the tobacco pot is mounted on the main body; the controlling member is movably mounted on the main body and is configured to drive the tobacco pot to move, the controlling member is moved to be in contact with the tobacco pot, then moved along the main body to drives the tobacco pot to move from the first position to a second position of the receiving chamber, the tobacco pot partially protrudes from the opening of the receiving chamber outside the receiving chamber.

2. The electronic cigarette according to claim 1, wherein the tobacco pot comprises a large-diameter section and a small-diameter section, a connecting portion is formed at the intersection of the large-diameter section and the small-diameter section, the controlling member is abutted against the connecting portion when moving to be in contact with the tobacco pot, so that the controlling member drives the tobacco pot to move when moving along the main body, and when the tobacco pot moves to the second position, the large-diameter section protrudes from the opening of the receiving chamber.

3. The electronic cigarette according to claim 2, wherein the controlling member comprises a controlling portion and a driving portion connected to the controlling portion, the controlling portion is movably mounted on the main body and exposed to an outer surface of the main body, when the controlling portion moves to the driving portion to be in contact with the connecting portion, the driving portion is connected to the connecting portion so that the controlling portion drives the tobacco pot to move when moving along the main body.

4. The electronic cigarette according to claim 3, wherein the driving portion is provided with a retaining hole, when the tobacco pot is mounted on the main body, the small-diameter section partially passes through the retaining hole, and the driving part abuts against the connecting portion when moving to be in contact with the large-diameter section, so that the controlling portion is connected to the connecting portion.

5. The electronic cigarette according to claim 1, wherein the tobacco pot is further provided with at least one air inlet, and the receiving space is in communication with external environment through the air inlet.

6. The electronic cigarette according to claim 1, wherein the tobacco pot is further provided with at least one hollow cleaning tank for exposing the receiving space from the tobacco pot.

7. The electronic cigarette according to claim 1, wherein the main body is provided with a heat generating device, and the heat generating device is configured for heating the receiving chamber when the main body operates so that the receiving chamber partially forms a heating section.

8. The electronic cigarette according to claim 7, wherein the tobacco pot is provided with a portion corresponding to the heat generating device, when the tobacco pot is mounted on the receiving chamber, the heat generating device is partially inserted into the portion, and when the tobacco pot moves from the first position to the second position, the portion of the tobacco pot is partially detached from the heat generating device.

9. The electronic cigarette according to claim 8, wherein the heat generating device comprises a heat generating rod, the portion is a through hole through which the outside is communicated with the receiving space, one end of the heat generating rod is mounted on the main body and is electrically connected to an internal electric component of the main body, and another end of the heat generating rod passes through the through hole and is received in the receiving space.

10. The electronic cigarette according to claim 7, wherein the electronic cigarette further comprises a heat insulating sleeve, the heat insulating sleeve is mounted in the receiving chamber and at least covers an inner chamber wall of the heating section of the receiving chamber, and the heat insulating sleeve is hollow, so that through which the tobacco pot partially passes through the heat insulating sleeve.

11. The electronic cigarette according to claim 2, wherein the main body is provided with a heat generating device, and the heat generating device is configured for heating the receiving chamber when the main body operates so that the receiving chamber partially forms a heating section.

12. The electronic cigarette according to claim 3, wherein the main body is provided with a heat generating device, and the heat generating device is configured for heating the receiving chamber when the main body operates so that the receiving chamber partially forms a heating section.

13. The electronic cigarette according to claim 4, wherein the main body is provided with a heat generating device, and the heat generating device is configured for heating the receiving chamber when the main body operates so that the receiving chamber partially forms a heating section.

14. The electronic cigarette according to claim 5, wherein the main body is provided with a heat generating device, and the heat generating device is configured for heating the receiving chamber when the main body operates so that the receiving chamber partially forms a heating section.

15. The electronic cigarette according to claim 6, wherein the main body is provided with a heat generating device, and the heat generating device is configured for heating the receiving chamber when the main body operates so that the receiving chamber partially forms a heating section.

16. The electronic cigarette according to claim 2, wherein when the large-diameter section protrudes from the opening of the receiving chamber, the large-diameter section and the small-diameter section can be separated.

* * * * *